US009323173B2

(12) United States Patent
Kihara et al.

(10) Patent No.: US 9,323,173 B2
(45) Date of Patent: Apr. 26, 2016

(54) IMAGE FORMING APPARATUS

(71) Applicant: CANON KABUSHIKI KAISHA, Tokyo (JP)

(72) Inventors: Hideo Kihara, Yokohama (JP); Motoki Adachi, Ashigarakami-gun (JP); Shuichi Tetsuno, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/579,992

(22) Filed: Dec. 22, 2014

(65) Prior Publication Data

US 2015/0177639 A1 Jun. 25, 2015

(30) Foreign Application Priority Data

Dec. 25, 2013 (JP) ..... 2013-267134

(51) Int. Cl.
*G03G 15/04* (2006.01)
*G03G 15/043* (2006.01)
*G03G 15/00* (2006.01)

(52) U.S. Cl.
CPC ..... *G03G 15/043* (2013.01); *G03G 15/556* (2013.01)

(58) Field of Classification Search
CPC ..... G03G 15/0831; G03G 15/0856; G03G 15/556; G03G 2215/0888
See application file for complete search history.

(56) References Cited

U.S. PATENT DOCUMENTS

2012/0230705 A1* 9/2012 Shimura et al. ..... 399/26
2014/0168339 A1* 6/2014 Adachi et al. ..... 347/118

FOREIGN PATENT DOCUMENTS

JP H08-194355 A 7/1996
JP 2002-296853 A 10/2002
JP 2008-8991 A 1/2008
JP 4822578 B2 11/2011

* cited by examiner

*Primary Examiner* — Gregory H Curran
(74) *Attorney, Agent, or Firm* — Canon USA Inc. IP Division

(57) ABSTRACT

An image forming apparatus includes an image bearing member, a charging apparatus, an exposure apparatus configured to expose the image bearing member charged by the charging apparatus to form an electrostatic latent image, a developing apparatus provided with a developer accommodation section and configured to develop the electrostatic latent image, a signal output unit configured to output a first signal for exposing a printing part of the image bearing member and a second signal for exposing a non-printing part of the image bearing member, a counting apparatus configured to receive the electric signal output from the signal output unit and count the first signals and the second signals, and a calculation apparatus configured to obtain a use amount of the developer by the developing apparatus from count values of the first signals and the second signals counted by the counting apparatus.

11 Claims, 8 Drawing Sheets

FIG. 5

| ZONE | ABSOLUTE MOISTURE CONTENT | BACKGROUND EXPOSURE WIDTH |
|---|---|---|
| 1 | LOWER THAN 5.8 | 4% |
| 2 | HIGHER THAN OR EQUAL TO 5.8 AND LOWER THAN 10.5 | 7% |
| 3 | HIGHER THAN OR EQUAL TO 10.5 AND LOWER THAN 15.0 | 10% |
| 4 | HIGHER THAN OR EQUAL TO 15.0 AND LOWER THAN 18.0 | 12% |
| 5 | HIGHER THAN OR EQUAL TO 18.0 | 14% |

FIG. 6

| ZONE | ABSOLUTE MOISTURE CONTENT | BG |
|---|---|---|
| 1 | LOWER THAN 5.8 | 1346400 |
| 2 | HIGHER THAN OR EQUAL TO 5.8 AND LOWER THAN 10.5 | 2356200 |
| 3 | HIGHER THAN OR EQUAL TO 10.5 AND LOWER THAN 15.0 | 3366000 |
| 4 | HIGHER THAN OR EQUAL TO 15.0 AND LOWER THAN 18.0 | 4039200 |
| 5 | HIGHER THAN OR EQUAL TO 18.0 | 4712400 |

IMAGE FORMING APPARATUS

BACKGROUND OF THE INVENTION

1. Field of the Invention

The present invention relates to an image forming apparatus that forms an image on a recording medium.

2. Description of the Related Art

In an image forming apparatus of an electrophotographic system or electrostatic recording system, to suppress an image density difference due to a transfer memory, the following method is proposed. That is, a region (non-printing part) other than a part where a toner image is formed by an exposure unit is also exposed at an exposure amount weaker than an exposure amount for exposing the toner image formation part. For example, this technology is described in Japanese Patent Laid-Open No. 2008-8991. Hereinafter, the exposure on the region other than this toner image formation part will be referred to as background exposure.

In a DC contact charging system in which a DC voltage is applied to a charging roller for charging a photosensitive member, DC voltage of a high-voltage unit that applies the voltage to the charging roller may be fixed to a predetermined value in some cases to aim at reducing a size of the high-voltage unit. It is also proposed that the background exposure is performed at this time to cope with a change in a photosensitive member surface potential after the charging caused by a change in a film thickness of the photosensitive member or a change in a use environment (see Japanese Patent Laid-Open No. 2002-296853).

One of the methods of performing the background exposure is a technique for exposing an entire area of an image region at a weak light quantity (hereinafter, referred to as analog background exposure).

Another method is a technique for performing the background exposure on the non-printing part by setting an exposure time period per unit region to be shorter than an exposure time period for the toner image formation part (printing part). Hereinafter, the above-mentioned method will be referred to as digital background exposure (see Japanese Patent Laid-Open No. 8-194355). The digital background exposure is effective, for example, when the exposure cannot be performed at a weak light quantity because of a characteristic of a laser element used in the exposure unit.

In addition, a method of using a counting unit that is configured to count electric signals (video signals) received by a laser driver that controls the laser element provided in the exposure unit is proposed as a method of predicting a toner use amount. The counting unit samples a specified number of video signals in a previously set image region and counts the number of video signals that are ON. The toner use amount is predicted by calculating a printing rate of a printed image from a ratio of the sample number to the count value. Hereinafter, the above-descried method will be referred to as video-count toner use amount predicting detection. Since the signals received by the laser driver are actually directly counted, it is possible to accurately detect the toner use amount (see Japanese Patent No. 4822578).

However, when the above-described video-count toner use amount predicting detection is performed in the image forming apparatus to which the digital background exposure system is mounted, the following problems may occur in some cases.

The above-described counting unit measures any signals whatever the video signals received by the laser driver are. For that reason, the counting unit also measures the signals received by the laser driver at the time of the exposure of the non-printing part where the toner image is not formed. However, the toner is not consumed in the exposure on this non-printing part. Accordingly, when the toner use amount is to be predicted by the video-count toner use amount predicting detection, the video signals related to the non-printing part are unnecessarily measured, and the toner use amount may be detected to be higher than the actual toner use amount in some cases.

In view of the above, the present invention aims at obtaining a developer use amount based on electric signals for instructing exposure in an image forming apparatus that sets the exposure time period for the non-printing part per unit region to be shorter than the exposure time period for the printing part per unit region.

SUMMARY OF THE INVENTION

According to an aspect of the present invention, there is provided an image forming apparatus including: an image bearing member; a charging apparatus configured to charge the image bearing member; an exposure apparatus configured to expose the image bearing member charged by the charging apparatus to form an electrostatic latent image, the exposure apparatus intermittently performing light irradiation for each unit region of the image bearing member; a developing apparatus provided with a developer accommodation section that accommodates developer and configured to develop the electrostatic latent image by the developer; a signal output unit configured to output an electric signal for instructing the exposure apparatus to perform exposure, the signal output unit outputting a first signal for exposing a printing part of the image bearing member where a developer image is formed and a second signal for exposing a non-printing part of the image bearing member where the developer image is not formed and setting an exposure time period for the second signal per unit region of the image bearing member to be shorter than an exposure time period for the first signal; a counting apparatus configured to receive the electric signal output from the signal output unit and count the first signals and the second signals; and a calculation apparatus configured to obtain a use amount of the developer by the developing apparatus from count values of the first signals and the second signals counted by the counting apparatus.

Further features of the present invention will become apparent from the following description of exemplary embodiments with reference to the attached drawings.

BRIEF DESCRIPTION OF THE DRAWINGS

FIG. 5 illustrates a table of a background exposure width that changes in accordance with a use environment of the image forming apparatus according to a second exemplary embodiment.

FIG. 6 illustrates a table of a BG value that changes in accordance with the use environment of the image forming apparatus according to the second exemplary embodiment.

DESCRIPTION OF THE EMBODIMENTS

First Exemplary Embodiment

Hereinafter, an image forming apparatus according to the present invention will be described in further detail with reference to the drawings. Embodiments that will be described below are to describe the present invention by way of examples, and dimensions, materials, shapes, relative arrangements, and the like of component parts that will be described below are not intended to limit the scope of the present invention thereto unless otherwise specifically described.

Overall Configuration of Image Forming Apparatus

Figure 1:
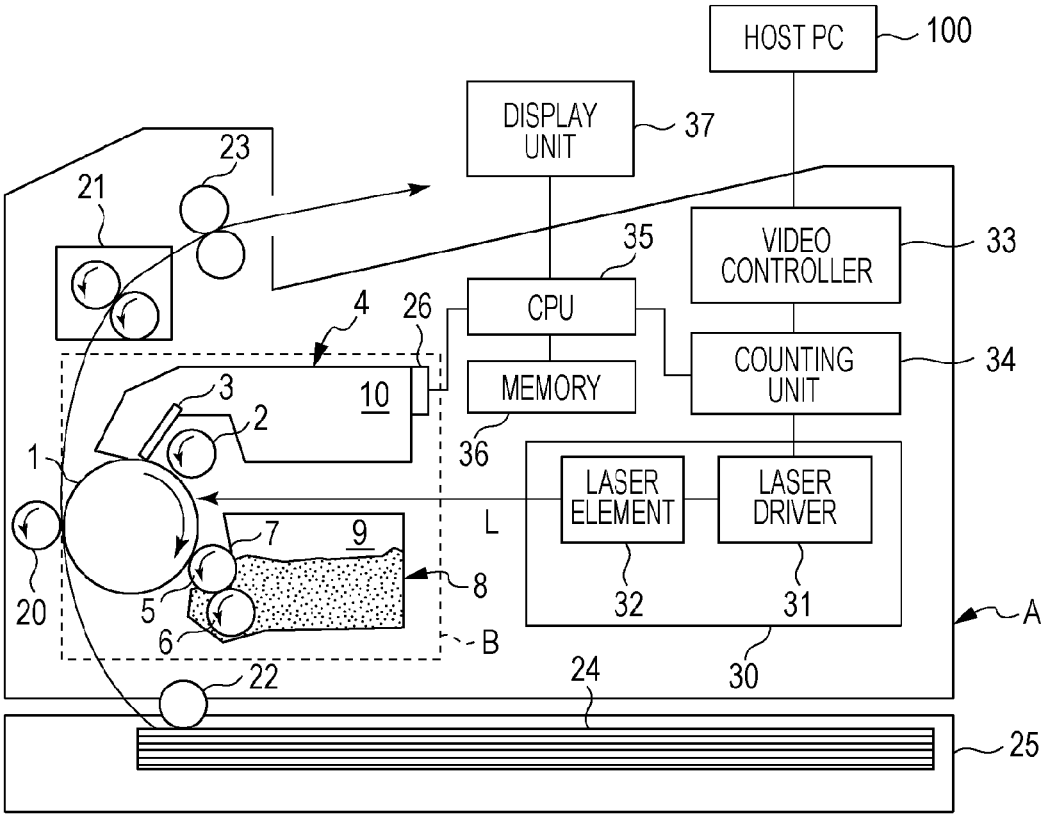
FIG. 1 is a schematic configuration diagram of an image forming apparatus according to a first exemplary embodiment.

FIG. 1 illustrates a schematic cross section of an image forming apparatus according to an exemplary embodiment of the present invention. An image forming apparatus A according to the present exemplary embodiment is used as a laser beam printer configured to form an image on a recording medium 24 such as a recording sheet, or an OHP sheet, in accordance with image information by an electrophotographic system. As will be described below in detail, a process cartridge B is detachably attachable to the image forming apparatus A according to the present exemplary embodiment.

The image forming apparatus A is used while being connected to a host 100 such as a personal computer. A video controller 33 processes a print request signal from the host PC 100 and image data and inputs an electric signal (video signal) in accordance with the image data to a laser driver 31 located within a scanner unit 30 functioning as an exposure unit (exposure apparatus). The laser driver 31 controls light emission of a laser element 32 in accordance with the input video signal, so that an electrostatic latent image is formed on an image bearing member. The video controller 33 is a signal output unit configured to output an electric signal for instructing the exposure.

The image forming apparatus A further includes a photosensitive drum 1 functioning as an image bearing member and a charging roller 2 (charging apparatus) configured to charge a surface of the photosensitive drum 1 at a predetermined potential. Furthermore, the image forming apparatus A includes a developing apparatus 8 configured to supply toner (developer) to the electrostatic latent image formed on the photosensitive drum 1 and develop the latent image as a toner image (developer image).

The photosensitive drum 1 has a cylindrical shape having an outer diameter of approximately 30 mm and rotates at a speed of 100 mm/sec in an arrow direction. The photosensitive drum 1 is the image bearing member (member that bears the image) on which the latent image (electrostatic latent image) and the toner image are formed.

The developing apparatus 8 includes a developing roller 5 for developing the latent image on the photosensitive drum 1 with the toner and a regulating blade functioning as a regulating member that regulates the toner amount on the developing roller 5. Furthermore, the developing apparatus 8 is constituted by a toner supply roller 6 functioning as a toner supply member (developer supply member) for supplying the toner to a development roller and a toner accommodation chamber (developer accommodation section) 9 that accommodates the toner.

The development roller is a developer bearing member that bears the toner (developer) on its surface and supplies the toner to the latent image on the photosensitive drum 1. The developing roller 5 abuts and rotates such that the surface rotates in a same direction as the photosensitive drum 1 in a development process. The development roller 6 stops the rotation at times other than the development process and is in a state of being separated from the photosensitive drum 1. An average particle diameter of the toner is approximately 6 μm.

The charging roller 2 is driven to be rotated while being arranged in pressure contact with the photosensitive drum 1. In addition, a transfer roller 20 that transfers the toner image formed on the photosensitive drum 1 to the recording medium 24 abuts against the photosensitive drum 1.

Furthermore, a cleaner unit 4 configured to remove residual toner remaining on the photosensitive drum after the transfer process is arranged for the photosensitive drum 1. The cleaner unit 4 is constituted by a cleaning blade 3 arranged to be in contact with the photosensitive drum 1 and remove the toner and a residual toner accommodation section 10 that accommodates the removed toner.

According to the present exemplary embodiment, the photosensitive drum 1, the developing apparatus 8, the charging roller 2, and the cleaner unit 4 are constituted as the process cartridge B that can be detachably attached to an apparatus main body of the image forming apparatus. A non-volatile memory 26 functioning as a unit configured to store a use history and information of the cartridge is mounted to the process cartridge B. It is noted that the apparatus main body refers to a part obtained by removing the process cartridge B from the image forming apparatus A.

The image forming apparatus A is also provided with a recording medium accommodation section 25 that accommodates paper or the like corresponding to the recording medium and a recording medium supply unit 22 that picks up the paper from the recording medium accommodation section 25 and conveys the paper. The image forming apparatus A is also provided with a fixing unit 21 configured to fix the toner image placed on the recording medium after the transfer onto the recording medium.

The image forming apparatus A is also provided with an environment sensor configured to detect a temperature and a humidity of an environment where the image forming apparatus is used.

Image Forming Process

The photosensitive drum 1 is uniformly charged by the charging roller 2. The uniformly charged photosensitive drum 1 is exposed by laser beam L from the scanner unit 30 functioning as the exposure unit, and the electrostatic latent image is formed on the surface of the charged photosensitive drum 1. Thereafter, this electrostatic latent image is visualized as the toner image while the developer is supplied by the developing roller 5.

On the other hand, the recording medium 24 is separated and fed from the recording medium accommodation section 25 by the recording medium supply unit 22, and the recording medium 24 is conveyed to an opposite part (transfer part) that faces the transfer roller 20 functioning as a transfer unit and the photosensitive drum 1 in synchronism with a formation timing of the toner image onto the photosensitive drum 1.

In this manner, the visualized toner image on the photosensitive drum 1 is transferred onto the recording medium 24 by an action of the transfer roller 20. The recording medium 24 onto which the toner image is transferred is conveyed to the fixing unit 21. Here, the unfixed toner image on the recording medium 24 is fixed onto the recording medium 24 by heat and pressure. Thereafter, the recording medium 24 is discharged to the outside of the machine by a discharge roller 23 or the like.

The residual toner remaining on the photosensitive drum 1 without being transferred is scraped from the photosensitive drum 1 by the cleaning blade 3, and the residual toner is accommodated into the residual toner accommodation section 10. The photosensitive drum 1 after the cleaning is repeatedly used for the image formation similarly in the above-described manner.

Regarding Exposure Operation

According to the configuration of the present exemplary embodiment, a DC voltage having a negative polarity is applied to the charging roller 2 and the developing roller 5 by a power supply unit (not illustrated) that can very an output. Subsequently, a control is performed such that a surface potential at the non-printing part of the photosensitive drum 1 is set to be constant even when the use environment is changed or when a film thickness of the photosensitive drum 1 is changed by varying the DC voltage applied to the charging roller 2 while the exposure of the background exposure is kept to be constant.

Next, an exposure method according to the present exemplary embodiment will be described in detail.

Laser irradiation is performed while scanning in a direction orthogonal to the rotation direction of the photosensitive drum 1. This direction orthogonal to the rotation direction of the photosensitive drum 1 will be referred to main scanning direction. The timing for the laser emission is controlled by the signal input from the video controller 33 to the laser driver 31 as described above. According to the present exemplary embodiment, to achieve an image resolution of 600 dpi, the exposure is performed while approximately 40 μm in the main scanning direction is set as one unit region (one dot). In addition, a region in the one dot is divided by approximately 100 to control the light emission.

Figure 7:
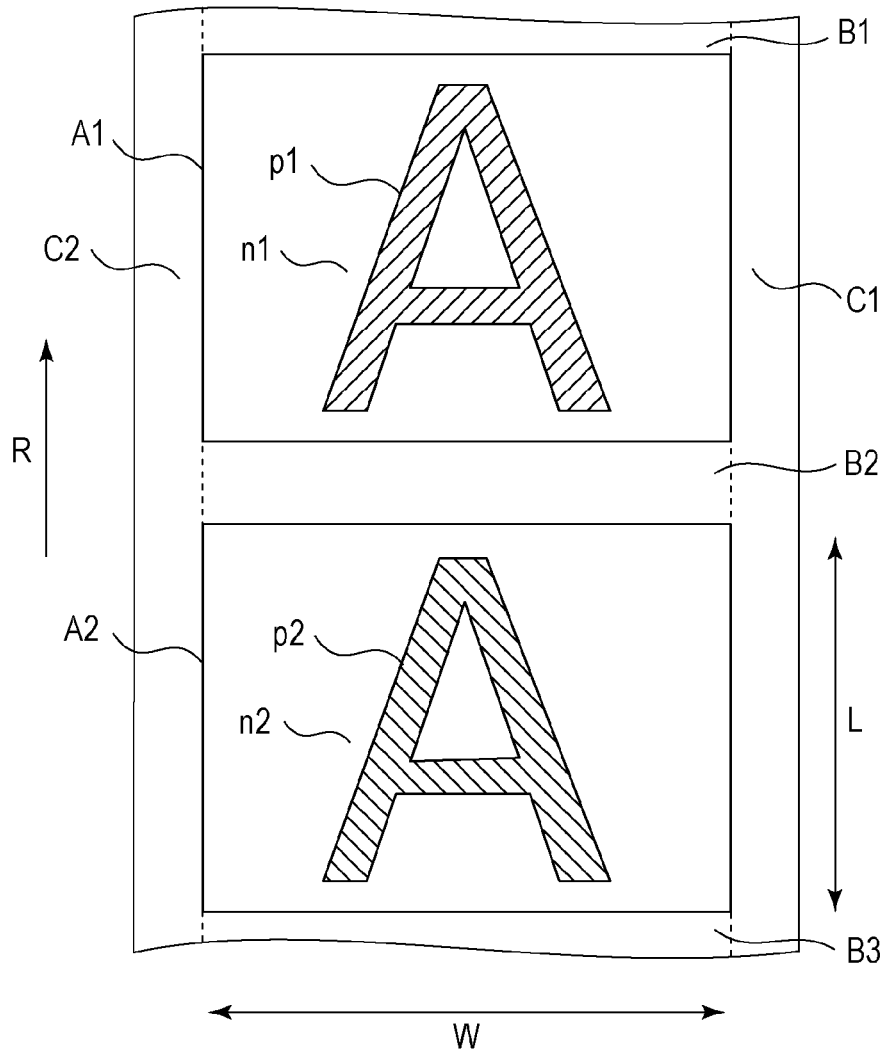
FIG. 7 illustrates an image region.

FIG. 7 is a schematic diagram (conceptual diagram) for describing an image forming unit that can form an image on a surface of the photosensitive drum 1 and the printing part and the non-printing part in this image forming unit. FIG. 7 illustrates a development diagram in a rotation direction (surface movement direction) R of the surface of the photosensitive drum 1.

Since the image forming apparatus A according to the present exemplary embodiment adopts a reversal development system, the exposure is performed on printing parts p1 and p2 (parts to which the toner is adhered) where the toner image is formed in the photosensitive drum 1. Furthermore, according to the present exemplary embodiment, the exposure is also performed on parts (non-printing parts n1 and n2) where the toner image is not formed corresponding to the background of the printing parts. It is possible to adjust the potentials at the non-printing parts n1 and n2 after the photosensitive drum 1 is charged in the background exposure by the exposure on the non-printing parts n1 and n2.

In the following descriptions, to illustrate the distinction, the exposure on the printing parts p1 and p2 will be particularly referred to as printing exposure, and the exposure on the non-printing parts n1 and n2 will be referred to as background exposure (non-printing exposure). A region obtained by combining the printing part p1 with the non-printing part n1 is a region where the toner image can be formed, that is, an image region A1 for forming the image. Similarly, a region obtained by combining the printing part p2 with the non-printing part n2 is an image region A2. The image regions A1 and A2 are also exposure regions where either the printing exposure or the background exposure is performed.

It is noted that the background exposure may be performed on non-image regions B1, B2, and B3 sandwiched between the image region and the image region in some cases, and the background exposure may not be performed in other cases. The selection is appropriately made on the basis of a configuration or the like of the image forming apparatus A. According to the present exemplary embodiment, the exposure is not performed on the non-image regions B1, B2, and B3. That is, the non-image regions B1, B2, and B3 are set as non-exposure regions.

In addition, edge regions C1 and C2 on an outer side of the image region A1 (outer side of a width direction W) may be the non-image regions in some cases depending on a width of the recording medium. According to the present exemplary embodiment, the edge regions C1 and C2 are both set as the non-exposure regions without the exposure. However, the background exposure may be performed on the edge regions C1 and C2 (the exposure regions may include the edge regions C1 and C2).

When the printing exposure is performed at the time of the toner image formation, the exposure at the width of at least 20 μm or longer is performed per (one) dot (per unit region). This is because, to form the latent image used for developing the toner on the photosensitive drum 1, the width of at least 20 μm or longer needs to be exposed.

On the other hand, when the background exposure is performed, the exposure is performed at the width of 4 μm. Accordingly, the surface potential of the photosensitive drum 1 charged by the charging roller 2 is changed by a certain amount. However, the background exposure region is not developed by the toner (the toner image is not formed).

That is, the amount of change (decreased amount of an absolute value) of the potential of the photosensitive drum 1 by the background exposure is lower than the amount of change by the printing exposure (decreased amount of an absolute value). For that reason, the toner is not moved from the developing roller 5 (see FIG. 1) onto the non-printing parts n1 and n2 on which the background exposure has been performed, and the toner is not adhered.

In the related art, the background exposure is performed by continuously performing the exposure in a state in which a light emission intensity of the laser is set to be weaker than the printing exposure. In contrast to this, according to the present exemplary embodiment, it is characterized in that a method of causing the laser to intermittently emit the light in the exposure is employed. That is, when the background exposure is performed, instead of weakening the laser light quantity, while the laser is caused to emit the light in the state of the light quantity at the time of the toner image formation (the same light quantity as the printing exposure), the light emission time is shortened (the width to be exposed by the laser is shortened).

In this manner, the exposure time period varies in the background exposure and the printing exposure, and as a result, the scanner unit 30 intermittently performs the exposure for every dot (unit region) of the photosensitive drum 1 for the background exposure.

According to the background exposure method in the related art, the light quantity needs to be weakened in the background exposure than that in the printing exposure. For that reason, the laser element needs a wide light quantity output range (light quantity variable range) from the weak light quantity for the background exposure up to the intense light quantity for the printing exposure used at the time of the toner image formation. Furthermore, the accuracy is also demanded in the entire area of the light quantity range, an expensive laser element needs to be used.

On the other hand, according to the present exemplary embodiment, since the light quantity is not substantially changed in the printing exposure and the background exposure, the light quantity variable range of the laser element can be limited. For that reason, it is possible to use a relatively inexpensive laser element. In addition, the exposure can be performed at the intense light quantity even in the background exposure. The photosensitive drum 1 is generally more stable for a sensitivity behavior with respect to the intense light quantity than a sensitivity behavior with respect to the weak light quantity. From this viewpoint too, the configuration of the present exemplary embodiment is advantageous.

Toner Use Amount Detection

According to the present exemplary embodiment, the video signal received by the laser driver 31 is measured by a counting unit 34 to detect the toner use amount. As illustrated in FIG. 1, the counting unit 34 is provided between the video controller 33 and the laser driver 31, and the signal received by the laser driver 31 is directly detected. It is possible to directly count the light emission by the laser related to the toner consumption by adopting this method. When the laser element performs the light emission to the photosensitive drum 1, the toner is moved from the developing roller 5 to the region of the exposed photosensitive drum 1, and the toner accommodated in the developing apparatus 8 is consumed. If the light emission by the laser can be detected, the toner consumption (use amount) can be found. As a result, the remaining amount of the toner accommodated in the developing apparatus 8 can also be found.

According to the method of calculating the toner use amount from the image information transmitted from the host PC 100 in the related art, it is difficult to detect the toner use amount by the cyclic toner ejection operation, the density detection control, or the like which is controlled by the apparatus main body of the image forming apparatus A. That is, even in a case where the image formation is not instructed from the host PC 100, the image forming apparatus A may consume the toner at the time of calibration or the like. However, such toner consumption cannot be detected from the image information received from the host PC 100.

To address this problem, according to the present exemplary embodiment, the video signal received by the laser driver 31 (electric signal for instructing the exposure) is counted by the counting unit 34. Since the light emission by the laser can be reliably detected in cases other than the image formation based on the instruction from the host PC 100, it is also possible to accurately detect the toner use amount consumed by the light emission.

The counting unit 34 performs the counting when the input video signal from the video controller 33 is ON and integrates the number.

It is however noted that, as described above, according to the method of directly detecting the video signal received by the laser driver 31, the video signal for causing the laser to emit the light in the above-described background exposure is also detected. Even when the background exposure is performed, the toner is not consumed. If the video signal for instructing the background exposure is also counted, and the count value is used for the calculation of the toner use amount, the toner consumption amount calculated on the basis of the video signals may be different from the actual toner consumption amount.

For that reason, according to the present exemplary embodiment, the toner use amount is calculated by a method which will be described below. First, a video signal for instructing the printing exposure is set as a first signal, and a video signal for instructing the background exposure is set as a second signal. According to the present exemplary embodiment, it is characterized in that the counting unit 34 is provided with a calculation unit configured to count both the first signal and the second signal and also obtain a count value of only the first signal from the counted count value by a calculation.

In the background exposure according to the present exemplary embodiment, the exposure is performed at the width equivalent to 10% of one dot, and in the printing exposure at the time of the toner image formation, the exposure is performed at the width equivalent to at least 50% of one dot. The counting unit 34 performs the sampling at a random timing in one dot and determines whether or not the video signal is ON. That is, the counting unit 34 has different timings for performing the sampling (counting) for each dot.

The sampling time of the counting unit 34 is shorter than the light emission time in the background exposure, and if the video signal when a detection state of the counting unit 34 is High is in an ON state, the counting is performed.

Figure 2:
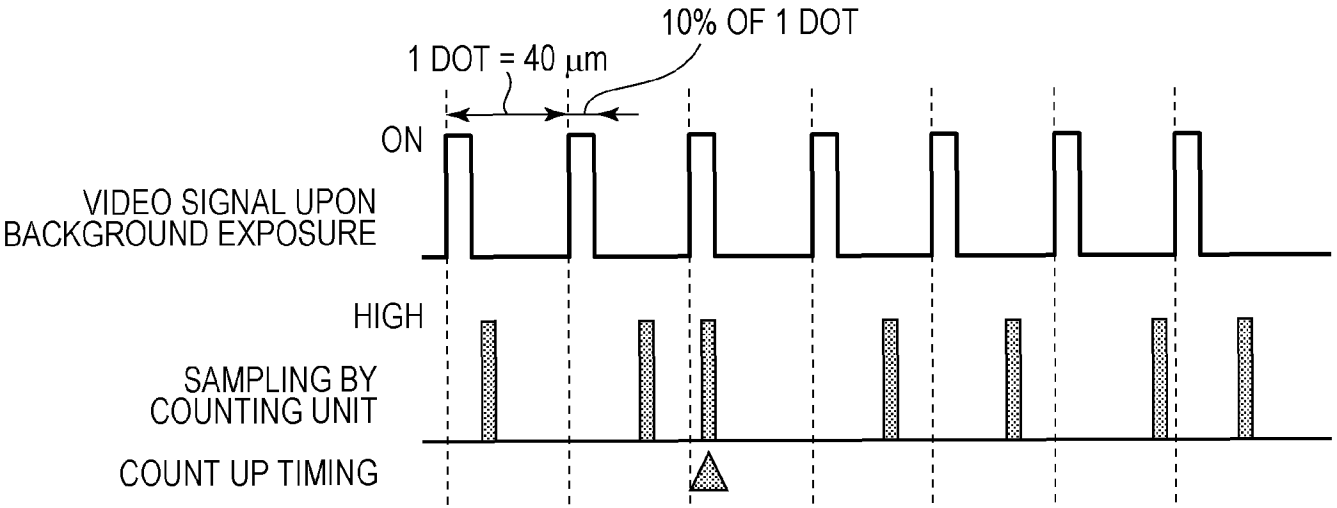
FIG. 2 illustrates a mode of timings for exposure on the image forming apparatus and a video count according to the first exemplary embodiment.

FIG. 2 illustrates the sampling performed by the counting unit 34 in a case where the background exposure is performed at the width equivalent to 10% of one dot on all the exposure regions (which are the image regions A1 and A2: see FIG. 7). Light emission at one dot out of seven dots is counted by the counting unit 34. Since the sampling by the counting unit 34 is performed at a random timing, a part of dots where the background exposure is performed is counted as a light emitting dot.

In a case where the sampling on the sufficient number of dots, such as all the dots of the printing image, is performed, a rate of the light emission by the background exposure counted by the counting unit 34 is proportional to a rate occupying the exposure width by the background exposure in one dot. Therefore, as in the present exemplary embodiment, in a case where the background exposure is performed at the width equivalent to 10% of one dot, it is assumed that 10% of dots in the printing dots emit the light and are counted by the counting unit 34.

That is, a rate at which the background exposure (the second signal) is counted by the counting unit 34 is lower than a rate at which the printing exposure (the first signal) is counted, but the background exposure (the second signal) is inevitably counted at a certain rate (approximately 10%).

Figure 3:
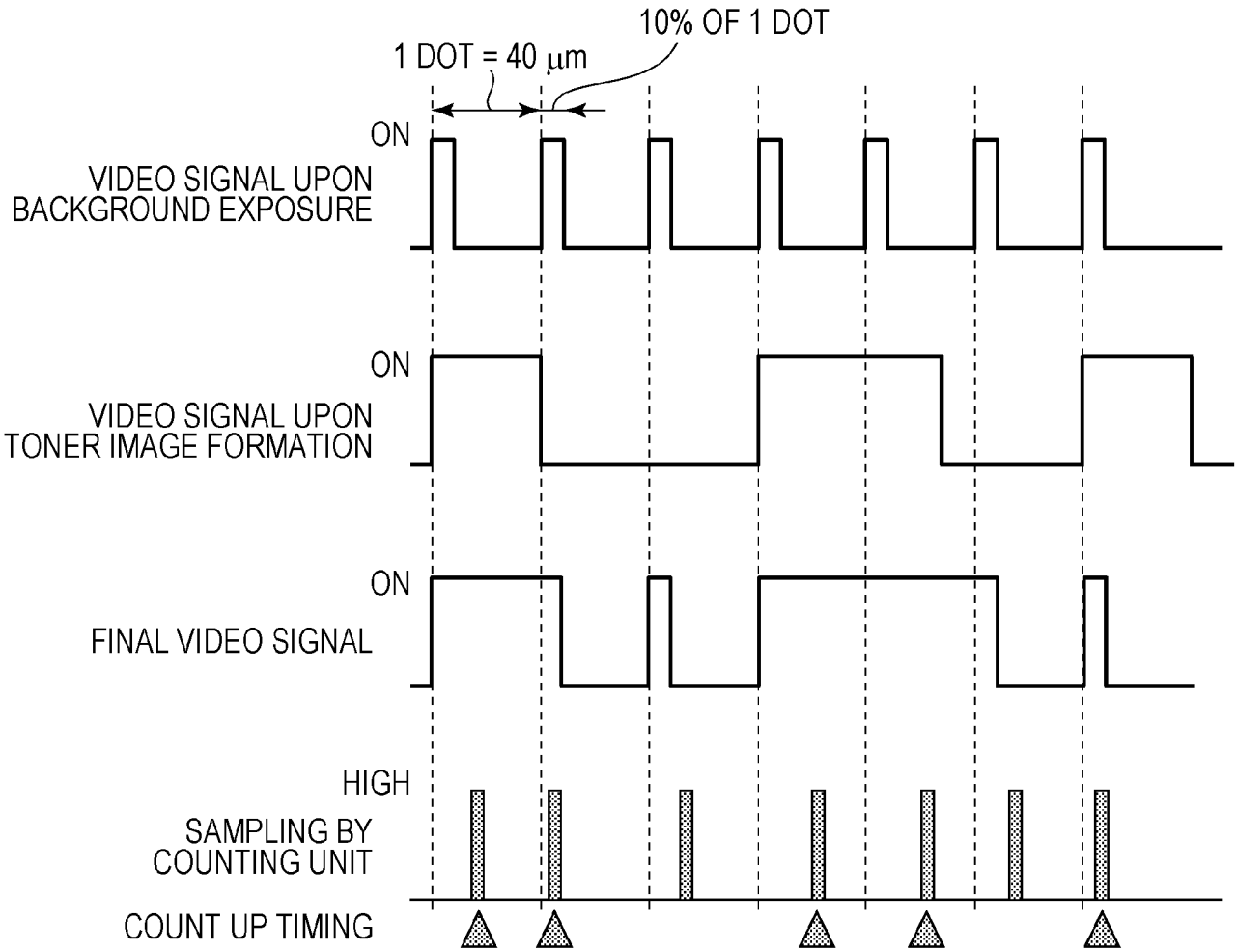
FIG. 3 illustrates a mode of timings for the exposure on the image forming apparatus and the video count according to the first exemplary embodiment.

In a case where the toner image formation is actually performed, as illustrated in FIG. 3, a final video signal (electric signal) obtained by overlapping the video signal (the video signal for the background exposure (the second signal) with the video signal at the time of the toner image formation (the first signal for the printing exposure) is counted. The counting unit 34 collectively counts the signals corresponding to the exposure in which the toner is not consumed (the signals corresponding to the exposure by the second signal).

For example, in FIG. 3, four dots among seven dots correspond to the printing exposure regions (p1 and p2) (the first, fourth, fifth, and seventh dots from the left). Three dots correspond to the background exposure regions (n1 and n2) (the second, third, and sixth dots from the left). Since the counting unit 34 also counts the seventh dot from the left corresponding to the non-printing region in addition to all the printing regions, the count number is 5 dots. That is, the counting unit 34 counts more than the count number (4 dots) equivalent to the printing exposure region.

To address the above-described problem, a method of only taking out the count value of the exposure in which the toner image formation is performed (count value of the first signals) by removing the influence from the count value for the background exposure (count value of the second signals) from the value counted by the counting unit 34 will be described.

An exposure count in which the toner image formation is performed (value obtained by counting the first signals for instructing the printing exposure) is set as X. A count value obtained by actually counted by the counting unit 34 is set as Y (value obtained by adding the value obtained by counting the first signals to the value obtained by counting the second signals).

A value counted by the counting unit 34 in a case where the printing exposure is performed on all the exposure regions (A1 and A2) is set as Z, and a value counted by the counting unit 34 in a case where the background exposure is performed on all the exposure regions (A1 and A2) is set as BG.

The value X to be obtained here (count value of only the first signals for instructing the printing exposure) is calculated by subtracting the value counted by the counting unit 34 in the background exposure (count value of the second signals) from Y (count value including both the first signals and the second signals). For that reason, the value X can be represented by the following expression.

$$X=Y-BG\cdot(Z-X)/Z \quad (1)$$

When this expression is represented in a form only using X, the following expression is obtained.

$$X=Z\cdot(Y-BG)/(Z-BG) \quad (2)$$

X: The count value equivalent to the counting of the printing exposure (the exposure by the first signal) (count value obtained by a calculation unit (a CPU 35) which will be described below).

Y: The count value actually counted by the counting unit 34 (count value including the counts of the first signals and the second signals).

Z: The count value counted by the counting unit 34 in a case where the exposure regions are all printing parts (count value equivalent to the counting in a case where the exposure is performed on all the exposure regions by only the first signals. This is a known value).

BG: The count value counted by the counting unit 34 in a case where the exposure regions are all non-printing parts (count value equivalent to the counting in a case where the exposure is performed on all the exposure regions by only the second signals. This is a known value).

Z and BG are the values determined by sizes of the exposure regions (A1 and A2). That is, since Z and BG are the values determined by a sheet size that determines a size of the image region (the width W or the length L illustrated in FIG. 7), the values may be previously stored for each sheet size. It is possible to take out only the counting of the exposure in which the toner image formation is performed by using the above-described Expression (2).

A derivation method for Expression (1) will be described below.

The count value resulted from the first signals is proportional to the area of the region on which the printing exposure is performed. The count value corresponding to the printing exposure performed on all the exposure regions (A1 and A2) is Z, and the count value corresponding to the printing exposure performed only on the printing parts p1 and p2 among the exposure regions (A1 and A2) is X.

An area ratio of the exposure regions (that is, the image regions A1 and A2) to the printing exposure regions (that is, the printing parts p1 and p2) on which the printing exposure has been performed can be represented as follows by using Z and X. That is, the exposure regions (A1 and A2):the printing exposure regions (the printing parts p1 and p2)=Z:X.

A region obtained by removing the printing exposure regions (p1 and p2) from the exposure regions (A1 and A2) is the background exposure region on which the background exposure is performed. This background region is equivalent to the non-printing parts n1 and n2 (see FIG. 7). An area ratio of the exposure regions (A1 and A2) to the background exposure regions (the non-printing parts n1 and n2) is represented as follows. That is, the exposure regions (A1 and A2):the background exposure regions (the non-printing parts n1 and n2)=Z:Z−X.

That is, the area of the background exposure regions on which the background exposure is performed (the non-printing parts n1 and n2) occupies the area of all the exposure regions (A1 and A2) on which either the area of the printing exposure or the background exposure is performed by a ratio of (Z−X)/Z.

A count value in a case where the background exposure is performed on the entire area of the exposure regions (A1 and A2) is denoted by BG. For that reason, in a case where the background exposure is performed on (Z−X)/Z of the exposure regions (A1 and A2), a count value A by the background exposure is as follows.

$$A=BG\cdot(Z-X)/Z \quad (3)$$

A: The count value equivalent to the counting of the background exposure (the exposure by the second signal).

The count value Y actually counted by the counting unit 34 is obtained by adding the count value X resulted from the printing exposure for forming the toner image to the count value A resulted from the background exposure in which the toner image is not formed. Therefore, Y=X+A is established.

When this expression is transformed, (1) can be obtained by the following calculation.

$$X=Y-A=Y-BG\cdot(Z-X)/Z \quad \text{(1): Listed again}$$

Expression (1) is further transformed to establish Expression (2) corresponding to an expression for obtaining X.

$$X=Z\cdot(Y-BG)/(Z-BG) \quad \text{(2): Listed again}$$

That is, the CPU 35 (FIG. 1) functioning as the calculation unit (calculation apparatus) obtains the count value X by the printing exposure (the exposure by the first signal) on the basis of Expression (2). As may be understood from Expression (2), the count value X obtained by the CPU 35 can be obtained by a linear function in which the count value Y is set as a variable.

That is, when Expression (2) is transformed, the following expression can be obtained.

$$X=DY-E \quad \text{Expression (4)}$$

Where

D=Z/(Z−BG)>0, and

E=Z·BG/(Z−BG)>0.

Hereinafter, as an example, a case where an image at a printing ratio (print ratio) of 5% is printed on a sheet having a letter size (215.9 mm×279.4 mm) will be described. Since the number of all the dots for the letter size at the resolution of 600 dpi is 33660000 dots, Z is 33660000. Since BG is equivalent to 10% of Z, BG is 3366000. In a case where the printing is performed at the printing rate of 5%, 1683000 dots are used for the image formation, and the background exposure is performed on the remaining 31977000 dots. Therefore, Y=1683000+31977000×0.1=4880700 is established.

This expression is assigned to the above-described Expression (2), X=1683000 can be obtained.

Thus, it is possible to obtain the count value equivalent to the printing exposure from which the influence of the background exposure is removed.

Figure 4:
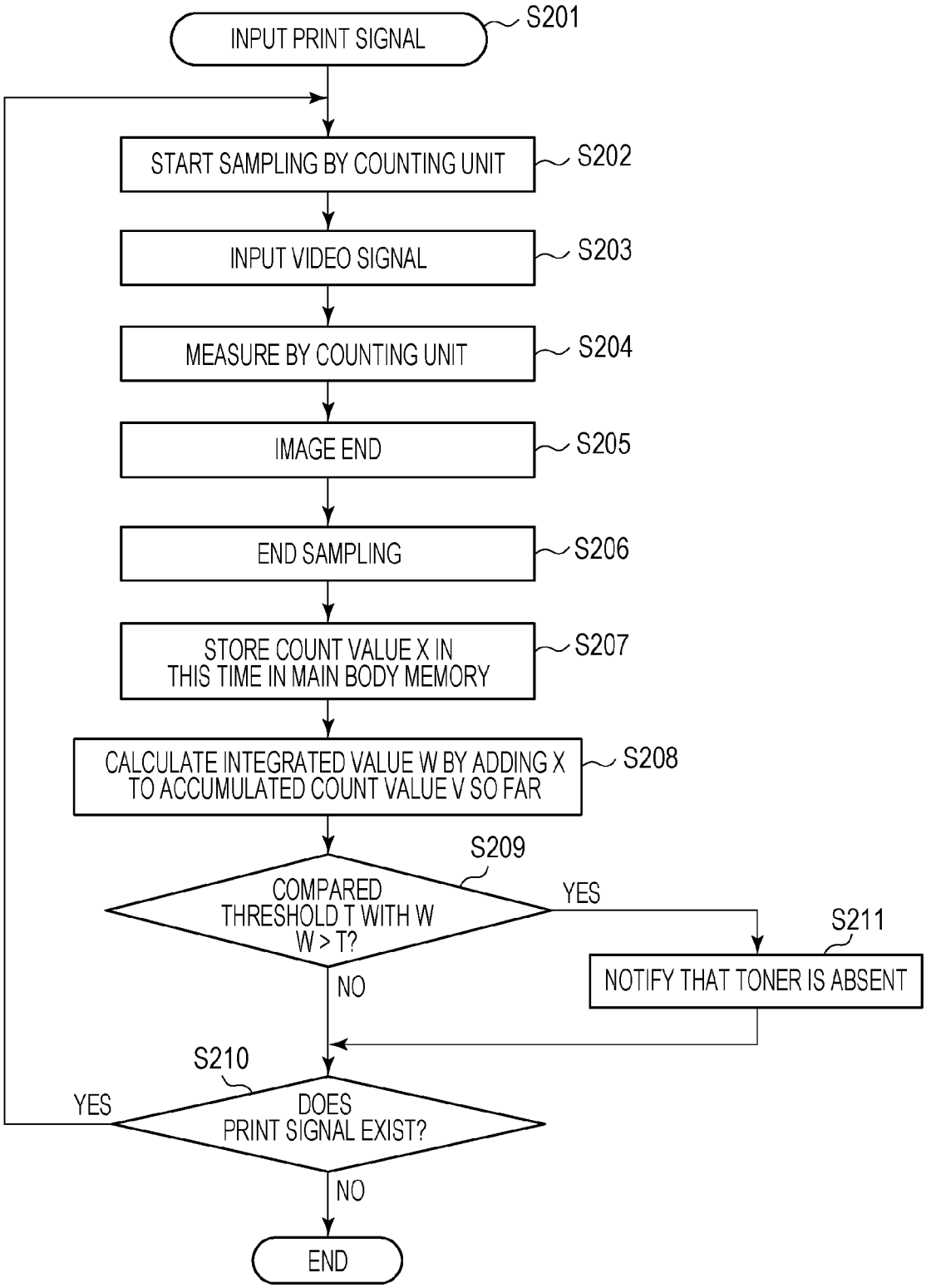
FIG. 4 is a detection flow for a toner use amount at the time of an image formation.

Next, a specific flow of the toner use amount detection at the time of the image formation will be described on the basis of FIG. 4. When the print signal is input (S201), the counting unit 34 starts sampling (S202). The counting unit 34 measures the video signal received by the laser driver 31 from the video controller 33 (S203, S204). When image end information is received (S205), the counting unit 34 ends the sampling (S206).

The CPU 35 functioning as the calculation unit calculates X by using Expression (2) and Expression (4) from the value Y measured (counted) by the counting unit 34 to be aggregated for each of the images. The CPU 35 then temporarily stores X in a memory 36 mounted to the main body of the image forming apparatus (S207). The non-volatile memory 26 mounted to the process cartridge stores an integrated value V of the video counts accumulated so far and a previously set threshold T of the video counts. The threshold T is a previously set value on the basis of the toner remaining amount at which does not occur an image defect such as a blank area image. The threshold T is read out via the CPU 35 in advance and held in the memory 36. The CPU 35 calculates an integrated value W by adding the value X counted in the image formation in this time to the accumulated count value V (S208). The integrated value W is a value corresponding to the toner use amount.

The integrated value W is compared with the previously set threshold T (S209). When the integrated value W exceeds the threshold T (S209-Yes), it is notified that the toner is absent via a display unit 37 previously provided to the image forming apparatus (S211). When the integrated value W does not exceed the threshold T (S209-No), if the print signal exists (S210-Yes), the same process is executed again. If the print signal does not exist, the process is ended (S210-No), and the notification of the remaining amount of the toner which is estimated from the integrated value W and the value of the threshold T is performed via the display unit 37.

In this manner, the CPU 35 of the image forming apparatus A detects the toner use amount and determines the presence or absence of the toner. The CPU 35 then performs notification of information related to the toner use amount (the toner remaining amount).

Finally, the characteristics of the present exemplary embodiment described above are summarized.

The count value Y obtained by counting the video signals by the counting unit (counting apparatus) 34 is a value including not only the count value X of the first signals (signals for the printing exposure) but also the count value A of the second signals (signals for the background exposure).

That is, a probability that the light emission is counted by the counting unit 34 is proportional to a length of a time period during which the electric signal instructs the light emission (time period during which the signal is ON) per one dot. An ON time period of the second signal is shorter than an ON time period of the first signal, and a rate (probability) at which the second signal is counted is lower than a rate (probability) at which the first signal is counted. However, in a case where the sampling number is set to be sufficiently high, the second signal is also counted at a certain rate.

For that reason, to obtain the toner consumption amount, the count value X needs to be obtained from the count value Y.

In view of the above, according to the present exemplary embodiment, the count value X equivalent to the counting of the first signals is obtained from the count value Y on the basis of Expression (2) and Expression (4). The count value X is obtained as a linear function in which the count value Y is set as a variable.

The count value X is a value also corresponding to the toner consumption amount. Therefore, the CPU 35 can detect (calculate) the toner consumption amount from the count value X. If the amount of toner in the toner accommodation chamber of the developing apparatus 8 is stored in the non-volatile memory 26 or the like in advance, the toner remaining amount can also be detected (calculated).

As a result of the above-described control, even in a case where the background exposure is performed on the background part (the non-printing part), the image forming apparatus A can accurately determine how long the developing apparatus 8 and the process cartridge B can be still used.

For example, in a case where the image forming operation is performed while the background exposure is continuously performed on all the image regions, that is, a case where an image where the printing is not performed (full-white image where all the surface of the recording medium is white) is continuously formed, the toner consumption is almost 0. On the other hand, the counting unit counts the second signal (signal for the background exposure). However, according to the present exemplary embodiment, the CPU 35 obtains the count value X by removing the influence from the signal for the background exposure (influence from the count value A) from the count value Y by the counting unit. That is, the toner use amount calculated from the count value X by the CPU 35 remains 0, and even when the image formation is repeatedly performed, the notification of the increase of the use amount or the decrease of the toner remaining amount is not performed by the image forming apparatus A. The use amount or the remaining amount in the notification is not changed.

For that reason, the CPU 35 functioning as a notification unit (notification apparatus) can more accurately notify the display unit 37 or the host PC 100 of the toner use amount (the toner remaining amount).

Alternatively, it also becomes easier to appropriately change various conditions at the time of the image formation (such as a voltage value applied to the development roller) in accordance with the toner use amount.

It is noted that, according to the present exemplary embodiment, the background exposure is not performed on the non-image regions B1, B2, and B3 or the edge regions C1 and C2 illustrated in FIG. 7. However, if the background exposure is also performed on the non-image regions B1, B2, and B3 and the edge regions C1 and C2, the regions A1, A2, B1, B2, B3, C1, and C2 may be set as the exposure regions. Then, if Z and BG in Expression (1) (that is, D or E in Expression (4)) are set on the basis of the regions A1, A2, B1, B2, B3, C1, and C2 corresponding to the exposure regions, it is possible to detect the toner use amount similarly as in the present exemplary embodiment. That is, if Z and BG (D and E) are set in accordance with the size of the exposure regions, it is possible to detect the toner use amount (the toner remaining amount).

The values of Z and BG (that is, the values of D and E) in conformity to the size of the exposure region (condition for the background exposure) may be stored in the memory 36, the non-volatile memory 26 (see FIG. 1), or the like in advance.

Second Exemplary Embodiment

Next, a configuration in which the exposure width of the background exposure is varied in accordance with a use situation of the process cartridge will be described. Since a basic configuration (an entire configuration of the image forming apparatus and an outline of the image forming process) is the same as the first exemplary embodiment, descriptions thereof will be omitted, and only differences will be described.

Regarding Exposure Operation

According to the configuration of the present exemplary embodiment, a voltage fixed to −1000 V is applied to the charging roller 2, and a voltage fixed to −400 V is applied to the developing roller 5 from the power supply unit (not illustrated). While the voltages are fixed to these voltage values, electric components can be kept to a minimum, and it is possible to realize miniaturization of the power supply unit.

As this configuration is different from the configuration according to the first exemplary embodiment, even when the use environment is changed, to maintain the surface potential of the photosensitive drum 1 to be constant, a control for changing the exposure width of the background exposure per one dot is performed. That is, the exposure time period during which the background exposure (the exposure by the second signal) per one dot (unit region) is performed is changed in accordance with the environment where the image forming apparatus A is used.

For example, the background exposure width is fixed at approximately 10% (4 μm) of one dot according to the first exemplary embodiment, but as an absolute moisture content (absolute humidity) of the environment is increased, the background exposure is performed at a width longer than 4 μm according to the present exemplary embodiment. In other words, as the absolute moisture content is increased, the exposure time period per the unit region by the second signal is increased.

The detection of the use environment is performed by the environment sensor provided to the apparatus main body of the image forming apparatus, and a control for changing the exposure width of the background exposure is performed in accordance with the absolute moisture content measured by the environment sensor. According to the present exemplary embodiment, as illustrated in FIG. 5, an environment table divided into five zones is prepared, and a background exposure width corresponding to the zone is set. When the above-described control is performed, it is possible to set the surface potential of the photosensitive drum 1 after the charge is performed by the charging roller 2 depending on the environment to be constant. According to the present exemplary embodiment, the environment is divided by way of zones, but in a case where a detailed control needs to be performed, the calculation may be performed from the value of the absolute moisture content. As a parameter used for the environment control, a temperature or a humidity (relative humidity) may be used instead of the absolute moisture content for the environment control.

According to the present exemplary embodiment, as the humidity (the moisture content represented by the relative humidity or the absolute humidity) is increased, BG is increased (D and E are increased). However, the configuration is not limited to this, and various modifications can be adopted in accordance with the configuration of the image forming apparatus A.

Toner Use Amount Detection

Only a difference from the first exemplary embodiment will be described. According to the configuration of the present exemplary embodiment, the exposure width of the background exposure is set to be variable in accordance with the use environment. Therefore, the value counted by the counting unit 34 (the above-described value BG) in a case where the printing exposure is performed on all the exposure regions or a case where the background exposure is performed on all exposure regions is changed depending on the use environment. The value of BG is set in advance for each of the five zones classified depending on the environment.

As an example of the setting, FIG. 6 illustrates a table in which the value of BG is set in each of the environment zones in the case of the image formation at the letter size. The calculation for X in accordance with the use environment is performed in Expression (2) by using these values of BG. Similarly, in Expression (4), if the use environment is changed, the constant D and the constant E obtained from BG are set as different values to obtain X.

The toner use amount detection flow after this is the same as the first exemplary embodiment, and the descriptions thereof will be omitted.

Third Exemplary Embodiment

According to the present exemplary embodiment, a configuration in which the timing of the counting by the counting unit 34 is different from the first exemplary embodiment will be described.

According to the first exemplary embodiment, the timing for the counting unit 34 to count is random, but the sampling is performed at a timing corresponding to once per approximately one dot (see FIG. 3).

Figure 8:
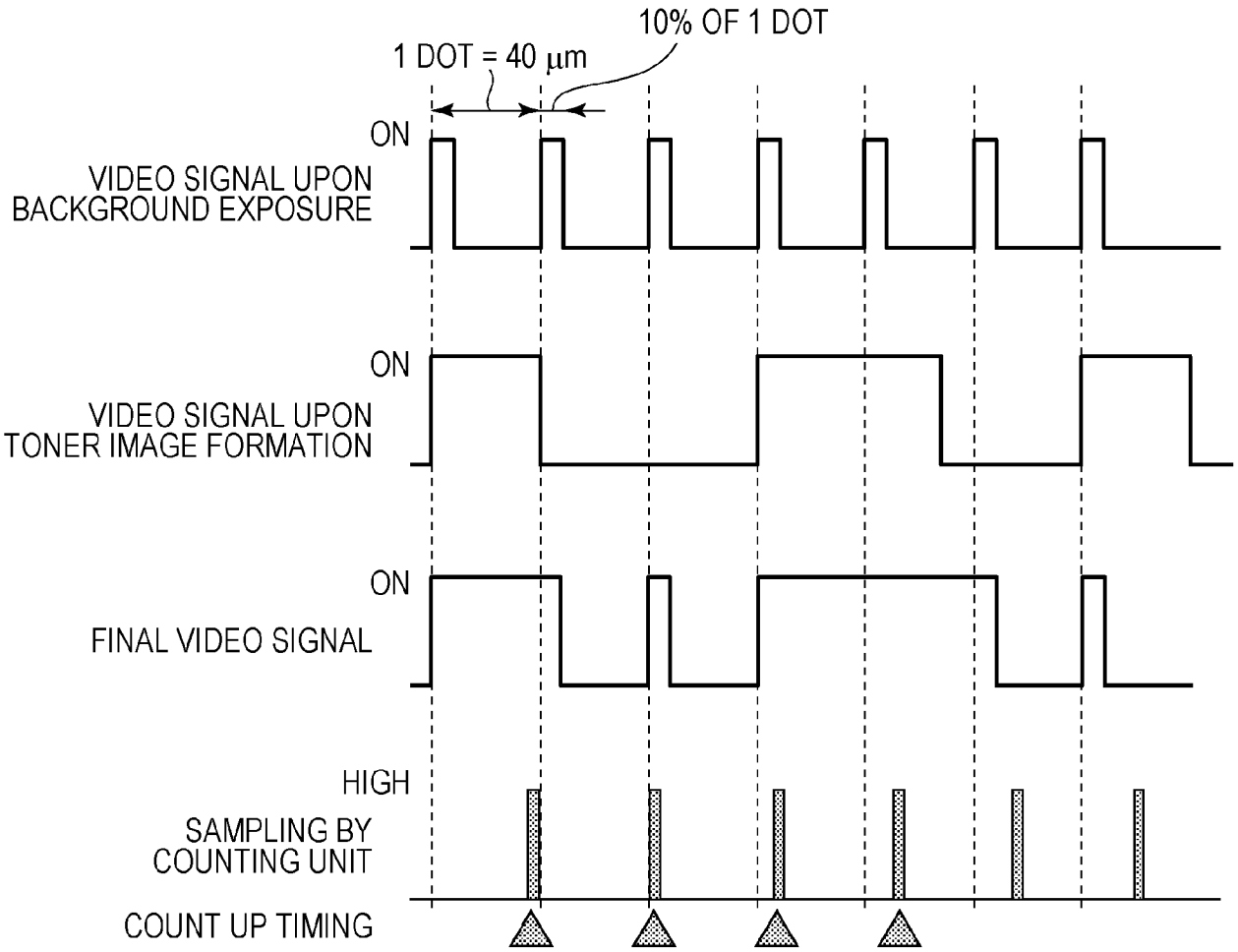
FIG. 8 illustrates a mode of timings for the exposure and the video count according to a third exemplary embodiment.

In contrast to this, according to the present exemplary embodiment, as illustrated in FIG. 8, the timing for the counting unit 34 to count is cyclic, but the counting timing is slower than a pace corresponding to once per one dot. In FIG. 8, the counting unit 34 performs counting at a pace corresponding to once per approximately 1 or 2 dots.

A cycle of the video signal (one cycle per one dot) is an extremely short time period. For that reason, depending on a capability of the counting unit 34, the counting cannot be performed in time for the cycle of the video signal. In this case, as illustrated in FIG. 8, the counting cycle of the counting unit 34 is longer than the cycle of the video signal (cycle of the light emission).

In this case, a dot that is not counted by the counting unit 34 at all is generated (the second dot from the left in FIG. 8). However, even in a case where the dot that cannot be counted by the counting unit 34 exists, if the sampling number by the counting unit 34 is sufficiently high, the count value Y by the counting unit (see Expression (1) according to the first exemplary embodiment) becomes a value actually coping with the exposure.

That is, if the sampling number is sufficiently high, even if the dots that are not counted are included at a certain rate (even if only a part of dots are sampled), it is possible to obtain an almost accurate count value in terms of statistics.

That is, the configuration is not limited to the configuration of the present exemplary embodiment, and the counting unit 34 may count the dots to an extent necessary for the statistical accuracy.

In addition, according to the present exemplary embodiment too, the timing for the counting unit 34 to count the video signal is different in each of the dots, and the second signal the background exposure is also counted at a certain rate. However, according to the present exemplary embodiment too, it is possible to obtain the count value X equivalent to the count for the first signal (signal for the printing exposure) on the basis of Expression (2) and Expression (4). The count value X obtained according to the present exemplary embodiment can also be set as a value sufficiently coping with the counting of the first signals in terms of statistics.

Finally, advantages common to the above-described respective exemplary embodiments are summarized as follows. That is, according to the configurations of the above-described respective exemplary embodiments, the image forming apparatus in which the exposure time period for the non-printing part per unit region is set to be shorter than the exposure time period for the printing part per unit region, it is possible to obtain the use amount of the developer by the electric signals for instructing the exposure.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-267134 filed Dec. 25, 2013, which is hereby incorporated by reference herein in its entirety.

What is claimed is:

1. An image forming apparatus comprising:

an image bearing member;

a charging apparatus configured to charge the image bearing member;

an exposure apparatus configured to expose the image bearing member charged by the charging apparatus to form an electrostatic latent image, the exposure apparatus intermittently performing light irradiation for each unit region of the image bearing member;

a developing apparatus provided with a developer accommodation section that accommodates developer and configured to develop the electrostatic latent image by the developer;

a signal output unit configured to output an electric signal for instructing the exposure apparatus to perform exposure, the signal output unit outputting a first signal for exposing a printing part of the image bearing member where a developer image is formed and a second signal for exposing a non-printing part of the image bearing member where the developer image is not formed, wherein an exposure time period per unit region of the image bearing member in a case where the exposure apparatus performs the light irradiation according to the second signal is shorter than an exposure time period per unit region of the image bearing member in a case where the exposure apparatus performs the light irradiation according to the first signal;

a counting apparatus configured to receive the electric signal output from the signal output unit, count the first signals and the second signals, and output a count value including a count value of the first signals and a count value of the second signals; and a calculation apparatus configured to obtain a use amount of the developer by the developing apparatus by calculating in such a manner that an influence from exposure according to the second signal is removed based on the count value output from the counting apparatus.

2. The image forming apparatus according to claim 1, wherein a probability that the counting apparatus counts the second signal is lower than a probability that the counting apparatus counts the first signal.

3. The image forming apparatus according to claim 1, wherein the calculation apparatus obtains the use amount by obtaining a count value equivalent to the counting of the first signals from the count value counted by the counting apparatus.

4. The image forming apparatus according to claim 3, wherein the count value equivalent to the counting of the first signals is obtained by a linear function in which the count value counted by the counting apparatus is set as a variable, and wherein the linear function can be represented as $X=DY-E$ ($D>0$, $E>0$) when the count value equivalent to the counting of the first signals is set as X, and the count value counted by the counting apparatus is set as Y.

5. The image forming apparatus according to claim 4, wherein the exposure time period per unit region exposed by way of the second signal is changed in accordance with a use environment of the image forming apparatus, and wherein the calculation apparatus changes a value of a constant used in the linear function in accordance with the use environment.

6. The image forming apparatus according to claim 5, wherein the D and the E are increased as a moisture content in the air in the use environment is increased.

7. The image forming apparatus according to claim 3, wherein the calculation apparatus obtains the count value equivalent to the counting of the first signals from the count value counted by the counting apparatus from the following expression:

$$X=Z\cdot(Y-BG)/(Z-BG)$$

where

X: the count value obtained by the calculation apparatus,

Y: the count value counted by the counting apparatus,

Z: the count value counted by the counting apparatus in a case where all the exposure regions of the image bearing member are exposed by the exposure apparatus exposed only by way of the first signals, and BG: the count value counted by the counting apparatus in a case where all the exposure regions are exposed only by way of the second signal.

8. The image forming apparatus according to claim 7, wherein the exposure time period per unit region exposed by way of the second signal is changed in accordance with the use environment of the image forming apparatus, and wherein the calculation apparatus uses different values for the BG in accordance with the use environment.

9. The image forming apparatus according to claim 1, wherein notification of information related to the use amount is performed.

10. The image forming apparatus according to claim 9, further comprising:

a notification apparatus configured to notify of the use amount of the developer obtained by the calculation apparatus or a remaining amount of the developer accommodated in the developer accommodation section obtained from the use amount, wherein the remaining amount or the use amount of the developer notified of by the notification apparatus is not changed in a case where image forming operation in which printing is not performed is continuously performed.

11. The image forming apparatus according to claim 1, wherein the counting apparatus has different timings for counting for each unit region.

* * * * *